United States Patent [19]

Hargreaves

[11] 4,117,695

[45] Oct. 3, 1978

[54] THERMODYNAMIC METHOD AND DEVICE FOR CARRYING OUT THE METHOD

[75] Inventor: Clifford McDonald Hargreaves, Eindhoven, Netherlands

[73] Assignee: U.S. Philips Corporation, New York, N.Y.

[21] Appl. No.: 259,915

[22] Filed: Jun. 5, 1972

[30] Foreign Application Priority Data

Jun. 14, 1971 [NL] Netherlands ..... 7108157

[51] Int. Cl.[2] ..... F25B 9/00

[52] U.S. Cl. ..... 62/86; 62/499

[58] Field of Search ..... 62/86, 115, 499; 417/207; 165/183

[56] References Cited

U.S. PATENT DOCUMENTS

| | | | |
|---|---|---|---|
| 2,393,338 | 1/1948 | Roebuck | 62/86 |
| 2,451,873 | 10/1948 | Roebuck | 62/401 X |
| 3,470,704 | 10/1969 | Kantor | 62/499 X |
| 4,010,018 | 3/1977 | Kantor | 62/499 |

*Primary Examiner*—Ronald C. Capossela
*Attorney, Agent, or Firm*—Frank R. Trifari; Rolf E. Schneider

[57] ABSTRACT

A thermocentrifugal pumping device in which a gaseous medium is supplied to a rotor element rotating about an axis, is first conducted inside the rotor element mainly in a radial direction away from the axis of rotation through a compression duct in which the medium is compressed by centrifugal action and in which heat of compression is withdrawn from the medium, in which the medium inside the rotor elements is then mainly conducted in the radial direction towards the axis of rotation through an expansion duct in which the medium expands against the centrifugal action before leaving the rotor element and in which so much thermal energy is supplied to the medium that the medium temperature in the expansion duct is always higher than the medium temperature in the compression duct so that flow of medium is produced in the rotor element in the direction from the compression duct to the expansion duct.

2 Claims, 14 Drawing Figures

THERMODYNAMIC METHOD AND DEVICE FOR CARRYING OUT THE METHOD

The invention relates to a thermodynamic method and a device for carrying out the method. A thermodynamic method and a device for heating puroses are known from the U.S. Pat. No. 2,451,873, in which a gaseous medium is supplied to a rotor element rotating about an axis, is first conducted inside the rotor element mainly in a radial direction away from the axis of rotation through a compression duct in which the medium is compressed by centrifugal force and in which heat of compression is with drawn from the medium; the medium inside the rotor element is then conducted mainly in the radial direction towards the axis of rotation through an expansion duct in which the medium expands against the centrifugal force and in which thermal energy is supplied to the medium; the medium is then removed from the rotor element.

The heat of compression released during compression of the medium is used in this case for the actual heating of the heating object. Thermal energy is supplied to the expanding medium so as to restrict the drop in temperature of the medium occurring as a result of the expansion.

Since the temperature of the medium in the expansion duct is lower than in the compression duct, and consequently the medium density in the first case is larger, the pressure gradient over the expansion duct as a result of the centrifugal forces will be larger than that across the compression duct. From this results a pressure differential which makes itself felt against the direction of flow. In order to maintain flow of medium in the direction from the compression duct to the expansion duct, the pressure in the medium inlet of the rotor element must be so much higher than that in the medium outlet that said pressure differential, as well as the medium frictional losses in the rotor element, are overcome. Therefore, a compressor is present in said known device to supply the required pressure differential for circulating the quantity of medium.

It is the object of the present invention to provide a method which gives the known thermodynamic device a quite different operation and which enables said device to be used advantageously for all kind of applications in which the device fulfils a quite different function.

For that purpose, the method according to the invention is characterized in that sufficient thermal energy is supplied to the medium that the temperature of the medium in the expansion duct is always higher than the temperature of the medium in the compression duct, and that with the resultant smaller density of the medium in the expansion duct than in the compression duct, flow of medium in the rotor element is produced in the direction from the compression duct to the expansion duct as a result of the centrifugal force.

In this manner it is achieved that the thermodynamic device has become a pumping device and a compressor, respectively, the operation of which is based on compelled convection of medium from the compression duct to the expansion duct by centrifugal force in both ducts on medium of different densities with the largest density in the compression duct, the latter in contrast with what is the case in the known device. Thus in the thermodynamic method describes in the United States Patent No. 2,451,873 medium is compressed by a compressor is supplied to the thermodynamic device, whereas according to the present invention, the thermodynamic device itself has become a compressor.

As compared with the known pumping devices and compression devices, respectively, the present thermodyamic centrifugal convection pumping device has all kinds of advantages. Drawbacks of conventional piston displacer pumps, such as large dimensions and high weight, oil leakage from the sump to the working space and so on, are not present here. As compared with, for example, turbine pumps, the flow losses in the present case are small, since, although the speed of rotation of the rotor element is high, the flow rate through the ducts is comparatively low. Due to the good balancing possibilities in the present pumping device, the noise and vibration levels can be maintained very low.

In the conventional pumping devices the compression is also far from isothermal, which means that in devices having high compression ratios the efficiency is low. With the present thermocentrifugal convection pumping device, large compression ratios can be realized with large centrifugal acceleration; for example a factor $2 \times 10^5$ larger than the acceleration of gravity, can be produced at the achievable high numbers of revolution of the rotor element, with the efficiency nevertheless high. This is in contrast with the compression space of conventional compressors in which moving components are present, and therefore no heat transmitting surfaces of any significance can be provided.

The compression ratio can be further increased by increasing the difference in temperature between the expansion duct and the compression duct. For a given temperature difference the compression ratio will further increase according as the average temperature level of the medium decreases and the average medium density hence increases.

The invention furthermore relates to a thermodynamic device suitable for carrying out the method. Such a device comprises at least a rotor element which is rotatable about an axis and through which a gaseous medium can flow. The rotor element has a medium inlet present on or near the axis of rotation and which, viewed in the direction of flow, communicates with a medium outlet present on or near the axis of rotation via successively a compression duct extending mainly in a direction transverse to the axis of rotation, a communication duct extending mainly parallel to the axis of rotation, and an expansion duct extending beside and mainly in the same direction as the compression duct; the compression duct comprises a cooling device and the expansion duct comprising a heating device.

The thermodynamic device according to the invention is characterized in that the heating device is constructed so that during operation it maintains the medium in the expansion duct at a temperature level higher than the temperature level of the medium in the compression duct.

A further object of the invention in the present thermodynamic device operating as a pumping device is to provide an optimum pumping effect. In order to realize this a heat exchanger is present which is incorporated partially in the medium outlet partially in the communication duct, and in which medium in the outlet can exchange thermal energy with medium in the communication duct. In this manner it is achieved that the medium upon arrival in the expansion duct is at the desirable temperature. By withdrawing thermal energy from the medium in the outlet, the medium temperature at that area is reduced to the inlet temperature. As a result of this the thermal efficiency of the device is high.

In a favorable embodiment of the thermodynamic device according to the invention, a plurality of rotor elements is present, the axes of rotation of which coincide in a common axis of rotation. The rotor elements are form a rigid rotor assembly in a cascade arrangement, in which of every two adjacent elements, the medium outlet of one element communicates with the medium inlet of the other element. In this manner a multistage compression device and pumping device, respectively, is obtained the compression ratio of which is proportional to the number of rotor elements.

Viewed in the direction of the common axis of rotation, for example, the rotor elements may all be arranged one after the other, or partly one after the other and partly one beside the other. In a further favorable embodiment of the thermodynamic device according to the invention, the rotor elements are arranged in a cylinder form and rotationally symmetrically around the common axis of rotation the center lines of the medium compression ducts are all present in one plane which extends at right angles to the common axis of rotation, said plane forming a cylinder end face. The center lines of the medium expansion ducts are all present also in one plane which extends at right angles to the common axis of rotation, said plane forming the other cylinder end face. As a result of this arrangement, only one cooling device for all the compression ducts and only one heating device for all the expansion ducts is sufficient, instead of a separate cooling and heating device, respectively, associated with each compression duct or expansion duct. As a result of the rotational symmetry of the arrangement, a good balancing of the device is furthermore ensured and the device is also compact.

The invention will now be described in greater detail with reference to the drawings in which a few embodiments of the pumping device and compression device, respectively, are shown diagrammatically and not to scale by way of example.

BRIEF DESCRIPTION OF THE DRAWINGS

FIG. 5*a* shows a diagram of a multistage compressor, while

DESCRIPTION OF THE PREFERRED EMBODIMENT

Figure 1A:
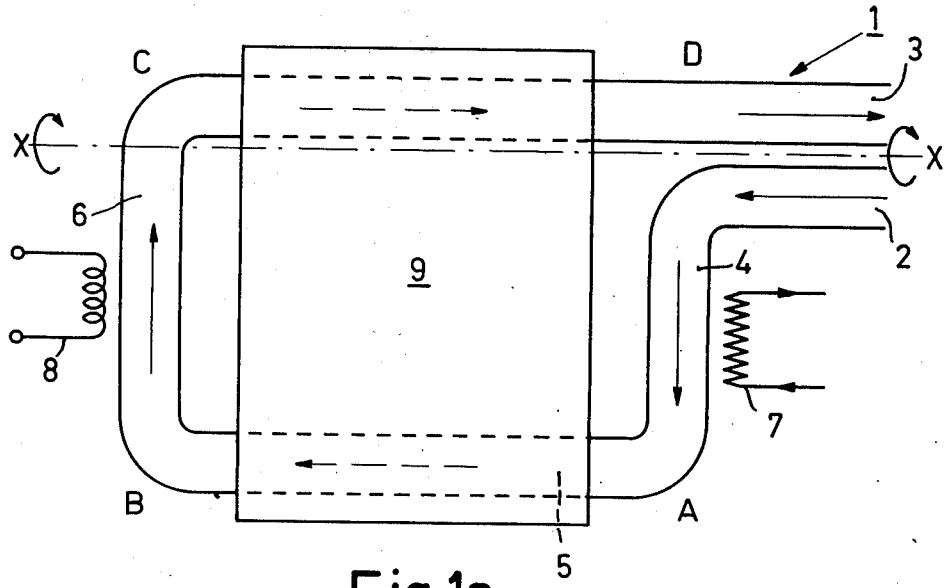
FIG. 1*a* shows a diagram of the pumping device and FIG. 1*b* shows the temperature variation during operation inside said device.

Reference numeral 1 in FIG. 1 denotes a rotor element which is rotatable about an axis X—X and which has a medium inlet 2 and a medium outlet 3 extending near the axis of rotation and parallel thereto. The medium inlet and outlet are in open communication with each other via successively a compression duct 4 extending transverse to the axis of rotation, a communication duct 5 extending parallel to the axis of rotation, and an expansion duct 6 extending transverse to the axis of rotation. Of course, the compression duct and expansion duct may also enclose angles other than 90° with the axis of rotation, while the communication duct may also enclose an angle with said axis instead of extending parallel thereto. It should only be ensured that upon rotation of the rotor element the centrifugal force makes itself felt in the expansion duct and the compression duct. Of course, optimum influence of this centrifugal action should be aimed at.

The compression duct 4 comprises a cooling spiral 7 as a cooling device, while the expansion duct 6 comprises a heating device 8, in this case constituted by an electric heating coil. A heat exchanger 9 is incorporated at one end in the medium outlet 3 and at the other end in the communication duct 5.

During operation, when the rotor element 1 rotates about the axis X—X, a gaseous medium is supplied to the medium inlet 2. Under the influence of centrifugal forces increasing radially outwards in value, said medium is increasingly compressed in the compression duct 4. The liberated heat of compression is dissipated by the cooling device 7, the cooling spiral through which a cooling liquid flows. When the compressed medium arrives in the expansion duct 6, said medium expands against the centrifugal forces decreasing in value with the decreasing radius. Sufficient thermal energy is now supplied by the heating device 8 that the medium temperature in the expansion duct 6 always remains higher than in the compression duct 4 notwithstanding the expansion. The medium density in the expansion duct 6 then is smaller than the medium density in the compression duct 4. As a result of this the pressure gradient as a result of the centrifugal forces across the compression duct is larger than that across the expansion duct, and a pressure differential results which makes itself felt in the direction of flow, so in the direction from the compression duct 4 to the expansion duct 6. So a pumping effect occurs in which medium is pumped from the inlet to the outlet. Due to the presence of the heat exchanger 9, the pumping device has a high thermal efficiency. Since thermal energy is withdrawn from the medium in the outlet 3, said medium leaves the pumping device at substantially the same temperature as at which it enters the inlet 2. With the thermal energy withdrawn from medium in the outlet 3, medium on its way to the expansion duct 6 is preheated so that it enters said duct already substantially at the expansion temperature. The thermal energy supplied with the heating coil 8 is optimum used in the above-described manner. Only the presence of the heat exchanger makes the pumping device interesting for practical application.

Figure 1B:
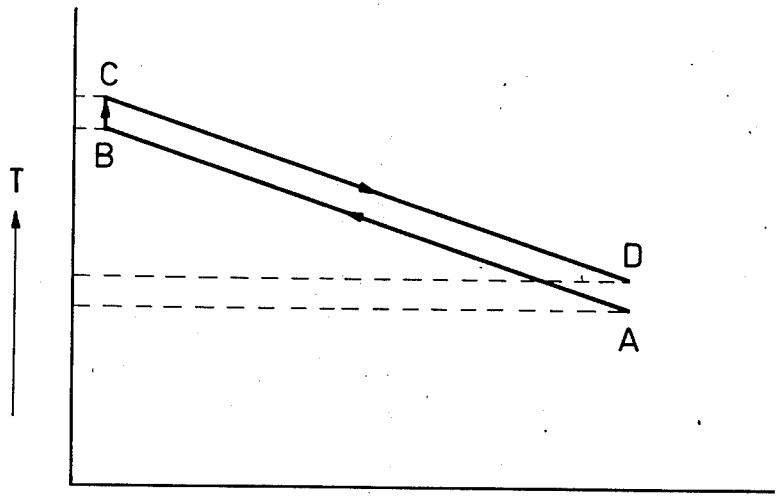

FIG. 1*b* shows the temperature variation of the medium upon traversing the rotor element, the places denoted by the letters A, B, C and D corresponding to places of FIG. 1*a* which are denoted by the same letters. The pumping effect and the compression ratio, respectively, of the pumping device can be increased with given dimensions of the device by increasing the number of rotations and/or increasing the temperature difference between medium in the expansion duct 6 and that in the compression duct 4. In the latter case the medium density difference between the two ducts consequently increases.

With a given temperature difference between the two ducts, the pumping effect increases according as the average temperature level of the medium decreases. Assuming, with a comparatively high average temperature level, the medium density in the compression duct to be $\rho_1$ and in the expansion duct to be $\rho_2$, the pumping effect is proportional to the density difference $\rho_1 - \rho_2$, while, if it is assumed that, with a comparatively low average temperature level, the medium density in the compression duct and expansion duct, respectively, is 2 $\rho_1$ and 2 $\rho_2$, respectively, the pumping effect is proportional to $2(\rho_1 - \rho_2)$.

Figure 2A:
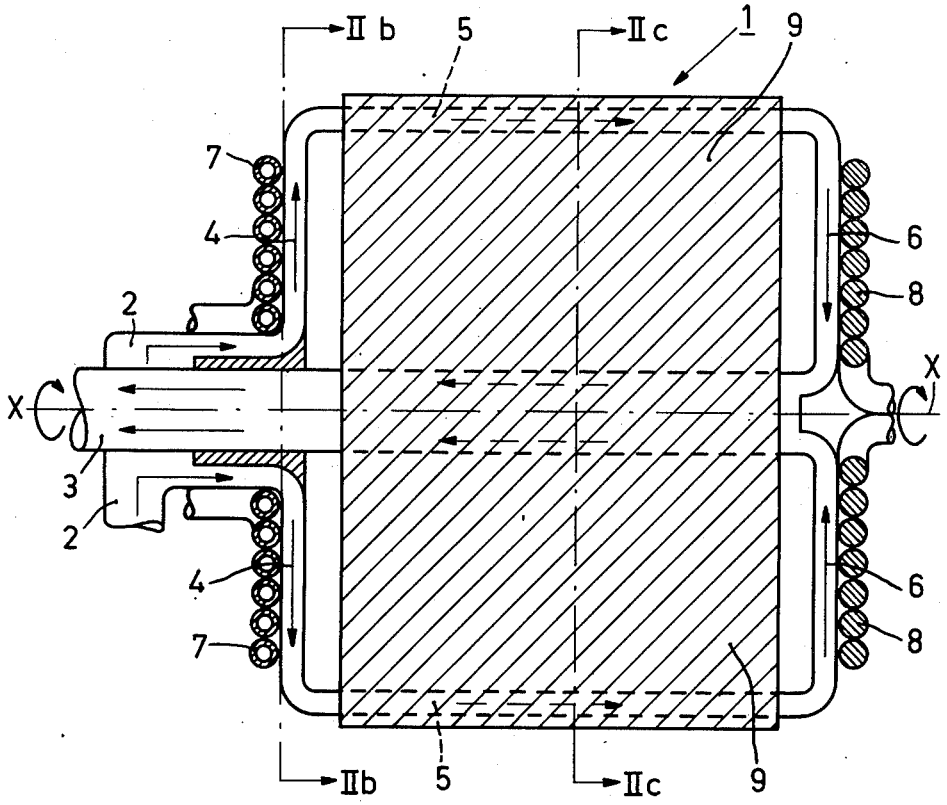
FIG. 2*a* is a longitudinal sectional view of the device.

FIG. 2*a* shows a rotationally symmetric pumping device in which components corresponding to FIG. 1*a* are referred to by the same reference numerals with a suffix *a*. Inlet 2*a* in this embodiment consists of an annular duct which surrounds the central outlet 3*a*.

Figure 2B:
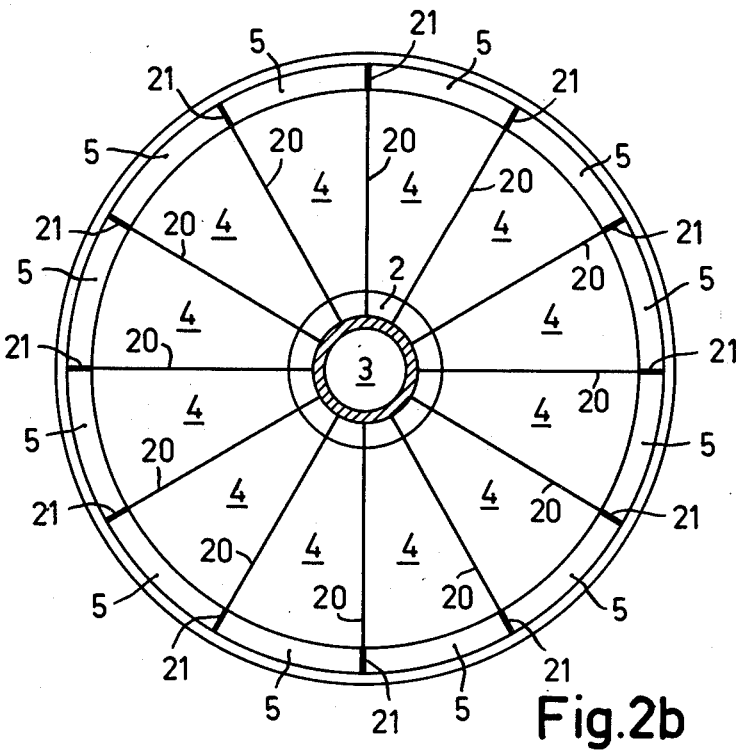
FIGS. 2*b* and 2*c* are cross-sectional views taken on the lines IIb—IIb and IIc—IIc respectively of FIG. 2*a*.

As shown in FIG. 2*b*, this embodiment comprises several compression ducts 4*a* which are separated from each other by radial partitions 20 and the same number of communication ducts 5*a* which are separated from each other by partition walls 21. Structurally in an identical manner to the compression ducts 4*a*, there are several expansion ducts 6*a* which are not shown. All the expansion ducts 6*a* open into the central outlet 3*a*.

The radial partitions with the compression ducts and expansion ducts in the partition walls between the communication ducts are not strictly necessary but inhibit the rotation of the medium mass about the axis of rotation.

Figure 2C:
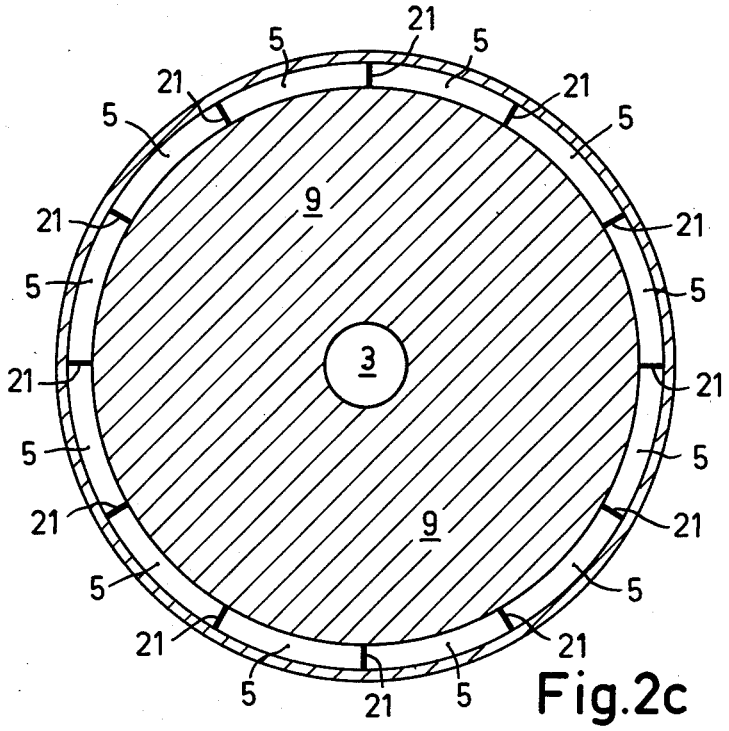

It is clear from FIG. 2*a* that medium in the communication ducts 5*a* can exchange heat with medium in the central outlet 3*a* via the heat exchanger 9*a*. Since the operation of the pumping device shown in FIG. 2 is the same as that of FIG. 1*a*, further description is omitted.

Figure 3A:
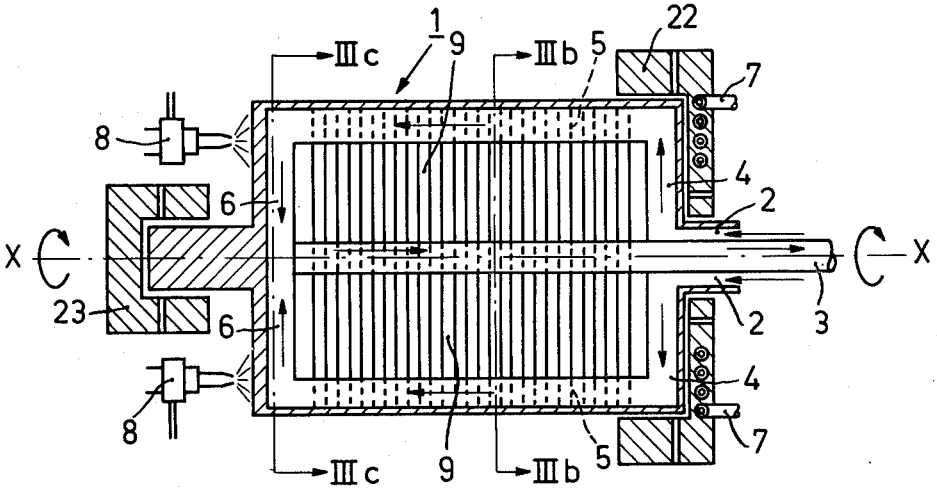
FIG. 3*a* is a longitudinal sectional view of another embodiment.

FIG. 3*a* shows a pumping device which in general is the same as that of FIG. 2*a*. For corresponding components the same reference numerals are used with a suffix *b*.

Cooling device 9*b* in this embodiment consists of ducts through which cooling medium can flow in bearing block 22 which, like bearing block 23, is provided with gas bearings. So in this case medium in compression ducts 4*b* is cooled via the gas bearings, while medium in the expansion ducts 6*b* is heated by means of burners 8*b*.

Figure 3B:
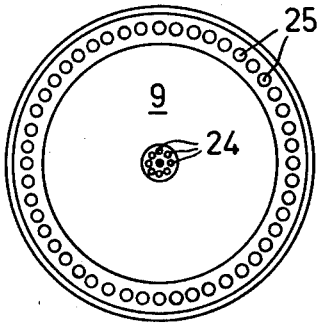
FIGS. 3*b* and 3*c* are cross-sectional views taken on the lines III*b*—III*b* and III*c*—III*c* of FIG. 3*a*.

Heat exchanger 9*b* has a stratified structure, namely a number of circular foils of a heat conducting material which are mutually spaced by spacing members of a heat insulating material. The foils are provided with apertures 24 and 25, respectively, in the center and at the edges. This is shown in detail in FIG. 3*b* which is a cross-sectional view through a foil taken on the line III*b*—III*b* of FIG. 3*a*. Medium flowing through the communication ducts 5*b* and passing apertures 25 absorbs thermal energy, via the foils, from medium which flows through the outlet 3*b* and passes the apertures 24. Due to the heat insulating spacing members, substantially no heat transport takes place between the foils mutually in the axial direction.

The foils may consist, for example, of copper owing to the good heat conducting properties of said metal. However, for example, aluminium is also to be considered which, although its heat conducting properties are less good, has a lower specific gravity as a result of which the rotor element 1*b* as a whole may be constructed to be of comparatively light weight which is favorable with respect to the journalling and balancing of said element. A more important advantage, however, is that higher circumferential speeds are possible due to the smaller mass forces. Of course, all kinds of other heat exchangers are possible, for example, gauze heat exchangers in which gauzes of wire or tape-shaped material take the place of the foils.

Figure 3C:
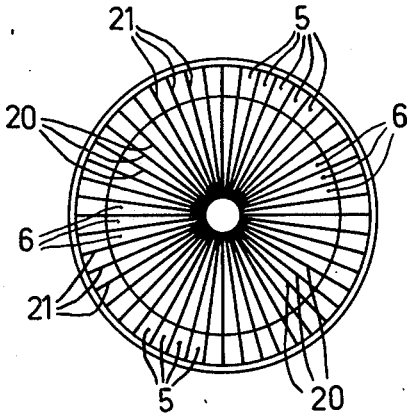

FIG. 3*c* is a cross-sectional view of the pumping device shown in FIG. 3*a* at the area of the expansion duct 6*b*. The operation of this pumping device is the same as that of FIG. 2*a* and need therefore not be further described.

Figure 4A:
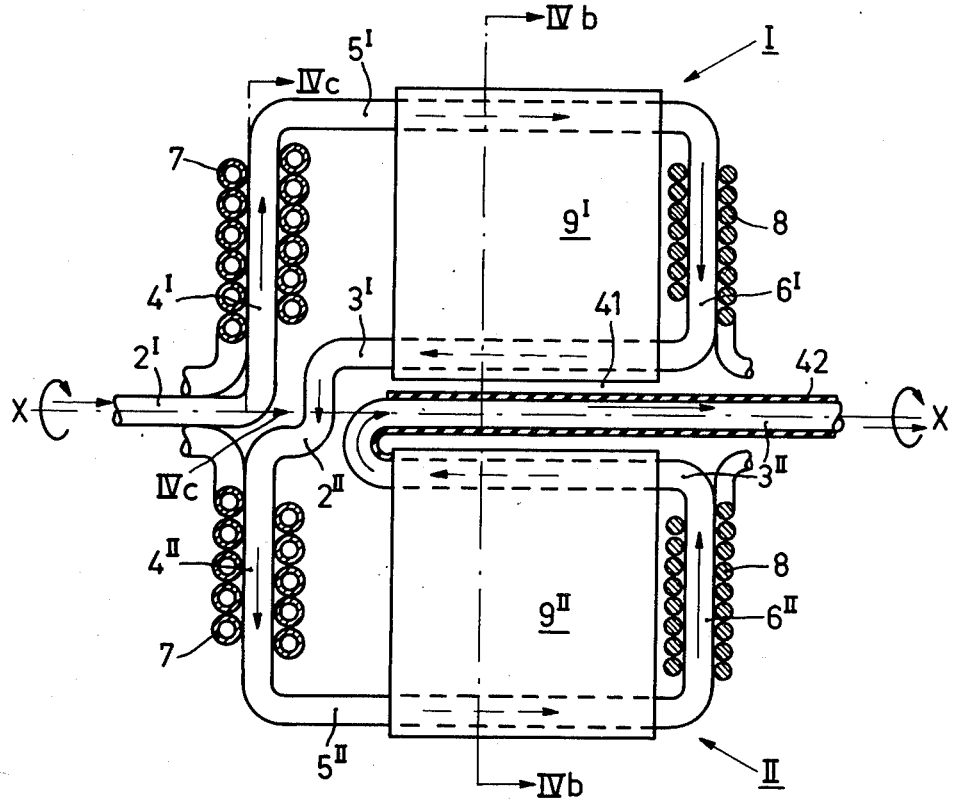
FIG. 4*a* is a longitudinal sectional view of a two-stage compressor device.

FIG. 4*a* shows a rotationally symmetric two-stage compressor constructed from two rotor elements I and II. For each rotor element the same reference numerals are used for components corresponding to the rotor element shown in FIG. 1, although accentuated by the addition of I and II, respectively.

The medium inlet $2^I$ is also the compressor inlet. The medium outlet $3^I$ communicates with medium inlet $2^{II}$. The medium inlet $3^{II}$ is also the compressor outlet.

A heat exchanger $9^I$ is incorporated between the communication duct and the medium outlet of rotor element I, while a heat exchanger $9^{II}$ is present between the communication duct and the medium outlet of rotor element II.

Figure 4B:
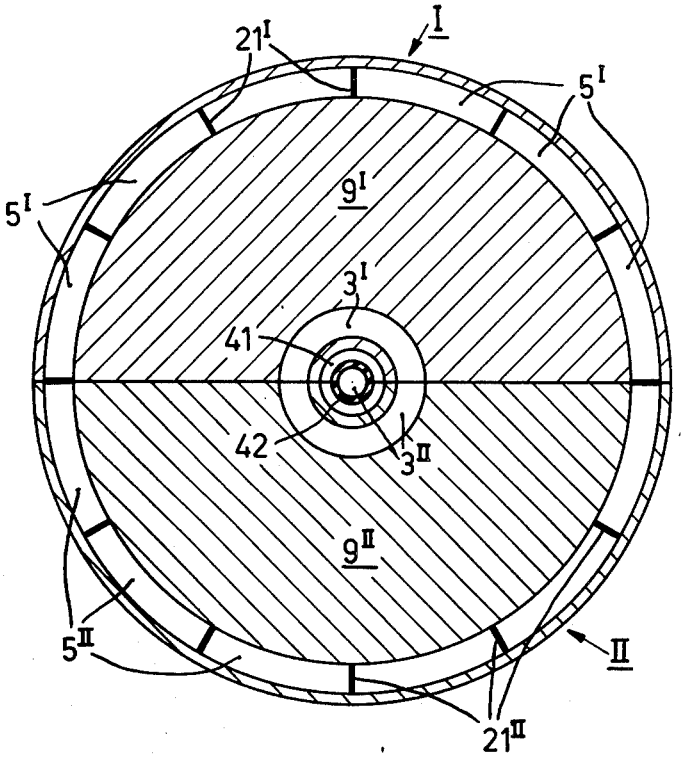
FIGS. 4*b* and 4*c* are cross-sectional views taken along lines IV*b*—IV*b* and IV*c*—IV*c* of FIG. 4*a*.
Figure 4C:
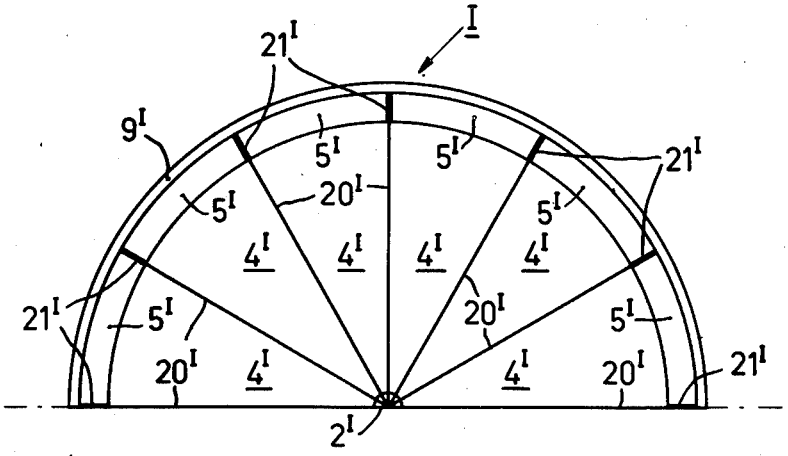

In analogy with FIGS. 2*a* and 3*a* each rotor element has a plurality of compression ducts $4^I$ and $4^{II}$, respectively, separated from each other by radial partitions $20^I$ and $20^{II}$, respectively, (see FIG. 4*c* in which this is shown for rotor element I in a cross-sectional view of FIG. 4*a* taken on the line IV*c*—IV*c*). Communicating therewith is the same number of communication ducts $5^I$ separated from each other by partition walls $21^I$. Communicating with the communication ducts $5^I$ are the same number of expansion ducts $6^I$ which communicate with the medium outlet $3^I$. The medium outlet $3^{II}$ of rotor element II serving as a compressor outlet is passed out through a central cavity 41 between the two heat exchangers $9^I$ and $9^{II}$ and inside the cavity thermally insulated relative to the said heat exchangers by an insulating layer 42. The compression ducts $4^I$ and $4^{II}$ have one common cooling device 7*e* while the expansion ducts $6^I$ and $6^{II}$ have one common heating device 8*e*. This is advantageous and possible, since the compression ducts of the two rotor elements are all arranged in one common plane, while the same applies to the expansion ducts. By arraning two rotor elements in series, the pumping pressure is doubled. This may be understood by considering that the medium pressure differentials $\Delta$ p generated in the individual rotor elements between the compression ducts and expansion ducts are summed due to the series arrangement.

Figure 5A:
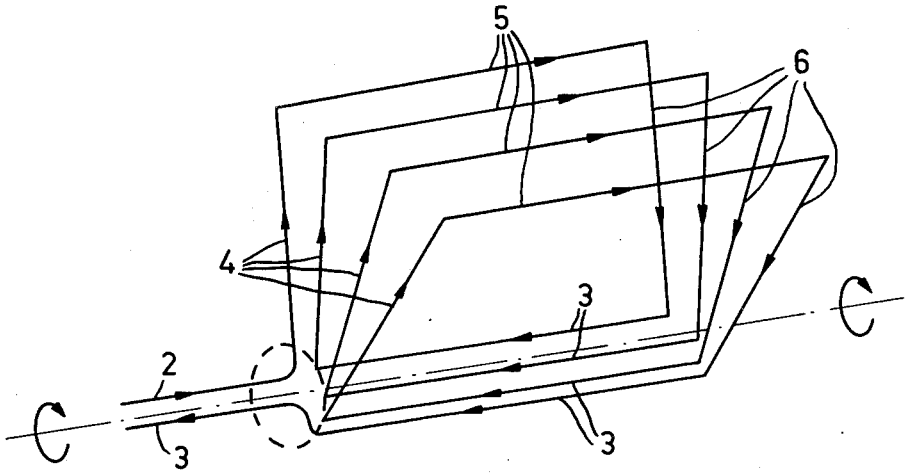

Extension of the present device to form a compressor having more than two stages while maintaining the rotational symmetry with good balancing and while using only one cooling device and heating device, respectively, can be carried out by arranging the rotor element in a cylinder form as is shown diagrammatically in FIG. 5*a* and, for clarity, is shown only for a few of the rotor elements forming the cylinder.

Figure 5B:
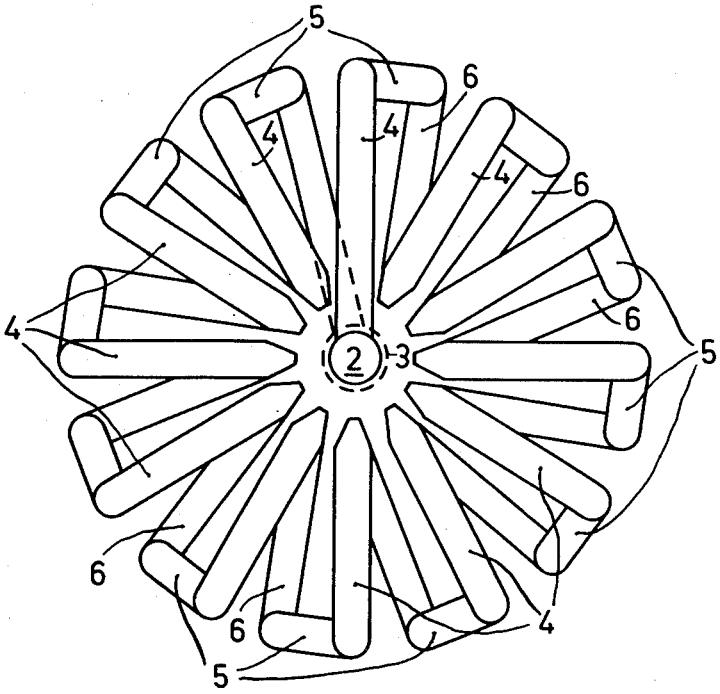
FIG. 5*b* shows an embodiment of a 12-stage compressor.

FIG. 5*b* is a side elevation of a 12-stage compressor so constructed, in which the medium outlet 3*d* which serves as a compressor outlet debouches outside the cylinder on the side where the expansion ducts 6*d* are present, while the medium inlet 2*d* is present on the side of the compression ducts 4*d*.

Figure 6:
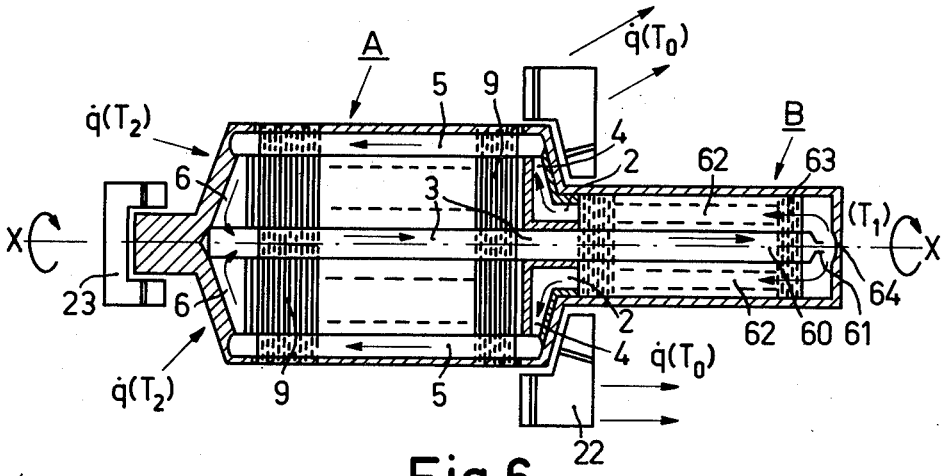
FIG. 6 shows a pumping device used in a coldproducing Joule-Thompson expansion system with which the pumping device forms one rigid and rotatable assembly.

FIG. 6 shows a cold-producing device in which a medium traverses a thermodynamic cycle in a closed system of ducts. Part A forms the pumping device which in this case is of the type as is shown in FIG. 3*a*, while part B constitutes the cold-producing system. For the pumping device, the same reference numerals are used for corresponding components as in FIG. 3*a* with a suffix e. The parts A and B are rigidly secured together and form one rigid rotatable assembly which can rotate at high numbers of revolution via a driving mechanism not shown. The cold-producing system is a Joule-Thompson system having an inlet for high pressure medium 60 communicating with the medium outlet 3*e* of the pumping device, a Joule-Thompson expansion valve 61 present on the axis of rotation and an outlet for low pressure medium 62 which communicates with the medium inlet 2*e* of the pumping device. Between the inlet 60 and the outlet 62 a heat exchanger 63 is incorporated in which expanded comparatively cold medium in outlet 62 can precool high pressure medium in inlet 60 before said medium expands in the J-Th expansion valve 61.

At the area of the outlet of J-Th valve 61 a freezer 64 is present through which cold produced by the expansion of the medium can be withdrawn from said medium for external cooling purposes.

During operation, the freezer 64 has a cooling temperature $T_1$, the compression duct 4*e* of the pumping device from which the heat of compression of the medium is withdrawn has a higher compression duct temperature $T_o$ and the expansion duct 6*e* to which thermal energy is supplied from without has an even higher expansion duct temperature $T_2$.

For none too low cooling temperatures, for example, neon, argon, nitrogen or crypton may be used as a medium, while for low cooling temperatures, for example, hydrogen, helium or the isotope $He^3$ may be chosen.

At comparatively high cooling temperatures, removal of the heat of compression from the compression duct 4 may be carried out, for example, by means of air cooling, while at comparatively low cooling temperatures, for example, liquid nitrogen may be used so as to maintain the comparatively low compression duct temperature. The cold-producing device forms a hermetically closed system without seals. In those cases in which only the pumping device rotates, seals are of course necessary. In order to give the pumping device in those cases a universal application, use may possibly be made of ferrofluidic seals between the structural parts rotating at high numbers of revolutions and the stationary part. In this case, rings of a magnetic liquid are held captured, under the influence of a magnetic field, in annular gaps transverse to the axis of rotation between magnetic elements which face each other and are secured on the stationary and rotating structural parts. The liquid rings therefore constitute gaps seals (Industrial Research, October, 1970: "Progress in ferrohydrodynamics").

In addition to the embodiments of the pumping device shown, all kinds of other embodiments are, of course, possible without departing from the scope of this invention.

What is claimed is:

1. Apparatus for compressing a gas, which comprises a rotor, means for rotating said rotor about its axis, gas inlet means adjacent said axis, separate gas outlet means adjacent said axis, a gas compression duct extending generally radially outwardly from said inlet means, a gas communication duct extending generally axially from said compression duct, a gas expansion duct extending generally radially inwardly from said communication duct to said outlet means, cooling means for removing thermal energy from compressed gas in said compression duct, heating means for supplying sufficient thermal energy to expanded gas in said expansion duct to thereby maintain the temperature of said expanded gas higher than the temperature of the compressed gas in the compression duct, and heat exchanger means for transferring heat from the expanded gas in said outlet means to the compressed gas in said communication duct, whereby gas is pumped from said inlet means to said outlet means by centrifugal force.

2. A method of compressing a gas, which comprises rotating about its axis a rotor having a gas inlet adjacent said axis, a gas compression duct extending generally radially outwardly from said gas inlet, a gas communication duct extending generally axially from said compression duct, a gas expansion duct extending generally radially inwardly from said communication duct, and a gas outlet extending from said expansion duct adjacent said axis; flowing a gas through said inlet, duct, and outlet system; removing heat of compression from the compressed gas in said compression duct; supplying sufficient heat to the expanded gas in said expansion duct to thereby maintain the temperature of said expanded gas higher than the temperature of the compressed gas in the compression duct; and transferring heat from the expanded gas in said gas outlet to the compressed gas in said communication duct at a rate to reduce the temperature of the gas discharged from the outlet substantially to the temperature of the gas introduced at the inlet.

* * * * *